US005367793A

United States Patent [19]

Deacon et al.

[11] Patent Number: 5,367,793

[45] **Date of Patent: * Nov. 29, 1994**

[54] WINTER GOLF SHOE SPIKES

[75] Inventors: Ernie L. Deacon, Nampa; Faris W. McMullin, Boise, both of Id.

[73] Assignee: Warm Springs Golf Club, Inc., Boise, Id.

[ * ] Notice: The portion of the term of this patent subsequent to Nov. 9, 2010 has been disclaimed.

[21] Appl. No.: 106,205

[22] Filed: Aug. 13, 1993

Related U.S. Application Data

[63] Continuation-in-part of Ser. No. 872,819, Apr. 24, 1992, Pat. No. 5,259,129.

[51] Int. Cl.[5] ..... A43B 5/00; A43B 15/00

[52] U.S. Cl. ..... 36/127; 36/59 R; 36/67 A; 36/67 D; 36/134

[58] Field of Search ..... 36/59 R, 67 R, 67 A, 36/67 B, 67 D, 127, 134, 59 A, 59 B, 67 C, 25 R, 59 C, 59 D

[56] References Cited

U.S. PATENT DOCUMENTS

| | | | |
|---|---|---|---|
| 39,575 | 8/1863 | Hyatt et al. | 36/67 B |
| 485,459 | 11/1892 | Crocker | 36/59 C |
| 962,719 | 6/1910 | Pratt | 36/59 B |
| 982,278 | 1/1911 | Kline | 36/67 A |
| 1,876,195 | 9/1932 | Youmans | 36/127 |
| 2,491,596 | 12/1949 | Zaleski et al. | 36/67 D |
| 3,487,563 | 1/1970 | Austin | 36/67 D |
| 3,512,275 | 5/1970 | Leavitt | 36/67 D |
| 3,559,310 | 2/1971 | Kiela | 36/7.3 |
| 3,583,082 | 6/1971 | Jordan, Jr. | 36/59 |
| 3,583,083 | 6/1971 | Drew | 36/62 |
| 3,672,077 | 6/1972 | Coles | 36/2.5 T |
| 3,818,617 | 6/1974 | Dassler et al. | 36/32 R |
| 4,141,158 | 2/1979 | Benseler et al. | 36/32 R |
| 4,180,923 | 1/1980 | Dassler | 36/32 R |
| 4,233,759 | 11/1980 | Bente et al. | 36/67 A |
| 4,309,376 | 1/1982 | Ueno et al. | 264/241 |
| 4,330,950 | 5/1982 | Reddien | 36/127 |
| 4,392,312 | 7/1983 | Crowley et al. | 36/67 R |
| 4,527,345 | 7/1985 | Lopez Lopez | 36/127 |
| 4,571,852 | 2/1986 | Lamarche et al. | 36/25 R |
| 4,587,748 | 5/1986 | Collins | 36/127 |
| 4,689,901 | 9/1987 | Ihlenburg | 36/59 C |
| 4,777,738 | 10/1988 | Giese et al. | 36/32 R |
| 4,782,604 | 11/1988 | Wen-Shown | 36/127 |
| 4,837,949 | 6/1989 | Dufour | 36/127 |
| 4,885,851 | 12/1989 | Peterson | 36/127 |
| 5,259,129 | 11/1993 | Deacon et al. | 36/134 |

FOREIGN PATENT DOCUMENTS

| | | | |
|---|---|---|---|
| 807754 | 1/1937 | France | 36/67 D |
| 493748 | 8/1991 | France | 36/67 B |
| 6877 | 4/1895 | Germany | 36/67 A |
| 185659 | 6/1907 | Germany | 36/59 D |
| 2529027 | 1/1977 | Germany | 36/67 D |
| 467815 | 12/1951 | Italy | 36/67 A |
| 1378461 | 12/1974 | United Kingdom . | |
| 1434282 | 5/1976 | United Kingdom | A43C 15/00 |
| 2223394A | 4/1990 | United Kingdom . | |
| 9103960 | 4/1991 | WIPO . | |

*Primary Examiner*—Paul T. Sewell
*Assistant Examiner*—Marie Denise Patterson
*Attorney, Agent, or Firm*—Frank J. Dykas; Craig M. Korfanta

[57] ABSTRACT

The invention is a replaceable golf shoe cleat or spike 10 for use in place of a standard metal spike 4. Winter golf shoe spike 10 preferably has a main cleat body 11 molded from a durable plastic type material in single unitary fashion. A threaded stud 13 is formed on the upper surface of generally concavo-convex flange 12 and protrudes axially therefrom. A plurality of traction ribs 15 are formed on the bottom traction surface of concavo-convex flange 12. While the ribs 15 may be present in a variety of configurations, they are preferably triangular ridges arranged in a radial fashion emanating from the center of concavo-convex flange 12.

13 Claims, 4 Drawing Sheets

WINTER GOLF SHOE SPIKES

This application is a continuation-in-part of copending application Ser. No. 07/872,819 filed 04/24/92 entitled WINTER GOLF SHOE SPIKES, now U.S. Pat. No. 5,259,129.

BACKGROUND OF THE INVENTION

1. Technical Field

This invention generally relates to cleat devices for shoes. More particularly, this invention relates to detachable cleats or "spikes" for golf shoes which are suitable for winter play.

2. Background Art

During the winter months, some greens keepers of golf courses prohibit the use of standard metal golf shoe spikes because of their detrimental effect on the fairways and greens of the golf course. This is especially true in the northern states where the dormancy period of grass can exceed six to nine months.

Many avid golfers continue golfing regularly throughout the winter months, even though they cannot use spikes. Until the instant invention, the only alternative for winter golfers who usually wear spikes has been to wear tennis shoes which do not damage the golf course. Besides the problem of not providing sufficient traction to the golfer, this tennis shoes approach requires an additional investment by the golfer in a second pair of shoes.

FIG. 1 of the drawings shows a typical prior art metal spiked golf shoe, which is there denoted as 1. A plurality of metal spikes 4 are attached to the sole 2 of golf shoe 1. Each metal spike 4 includes a molded unitary body 5 having a disk-shaped flange 7, and a threaded stud 9 formed on the upper surface of the flange. A pointed protuberance, or spike, 6 is formed on the bottom surface of the flange to provide traction for the wearer. A pair of installation tool engagement holes 8 are provided at diametrically opposing points in the bottom surface of flange 7 to facilitate the threaded engagement of the threaded studs 9 in each threaded hole 3 within the sole 2 of golf shoe 1.

A similar replaceable cleat golf shoe is taught in REDDIEN, U.S. Pat. No. 4,330,950. This patent teaches manufacturing the cleats from a non-conducting material to prevent the spikes from acting as an electrical connection to ground in the case of an electrical storm.

JORDAN, U.S. Pat. No. 3,583,082 teaches a removable track shoe cleat for use on synthetic type surfaces which incorporates a plurality of bristles protruding from the traction surface of each individual cleat or spike.

What is needed is a replaceable cleat or spike for use in place of a standard metal spike for a golf shoe which does not cause damage to the golf course, especially in inclement or cold weather. Accordingly, one of the objects of the instant invention is to provide a spike which satisfies this need.

DISCLOSURE OF INVENTION

This object, along with others, is accomplished by a replaceable cleat formed of a thermoplastic or similar material. The cleat has a plurality of ribs on the traction surface in place of standard pointed protuberances. The cleat is formed generally in a unitary body having a threaded stud axially protruding from the upper surface of a generally concavo-convex flange from the perspective of sole 2. The ribs may be present in a variety of configurations, and may be formed with an arcuate, triangular or rectangular cross section.

BEST MODE FOR CARRYING OUT INVENTION

Figure 1:
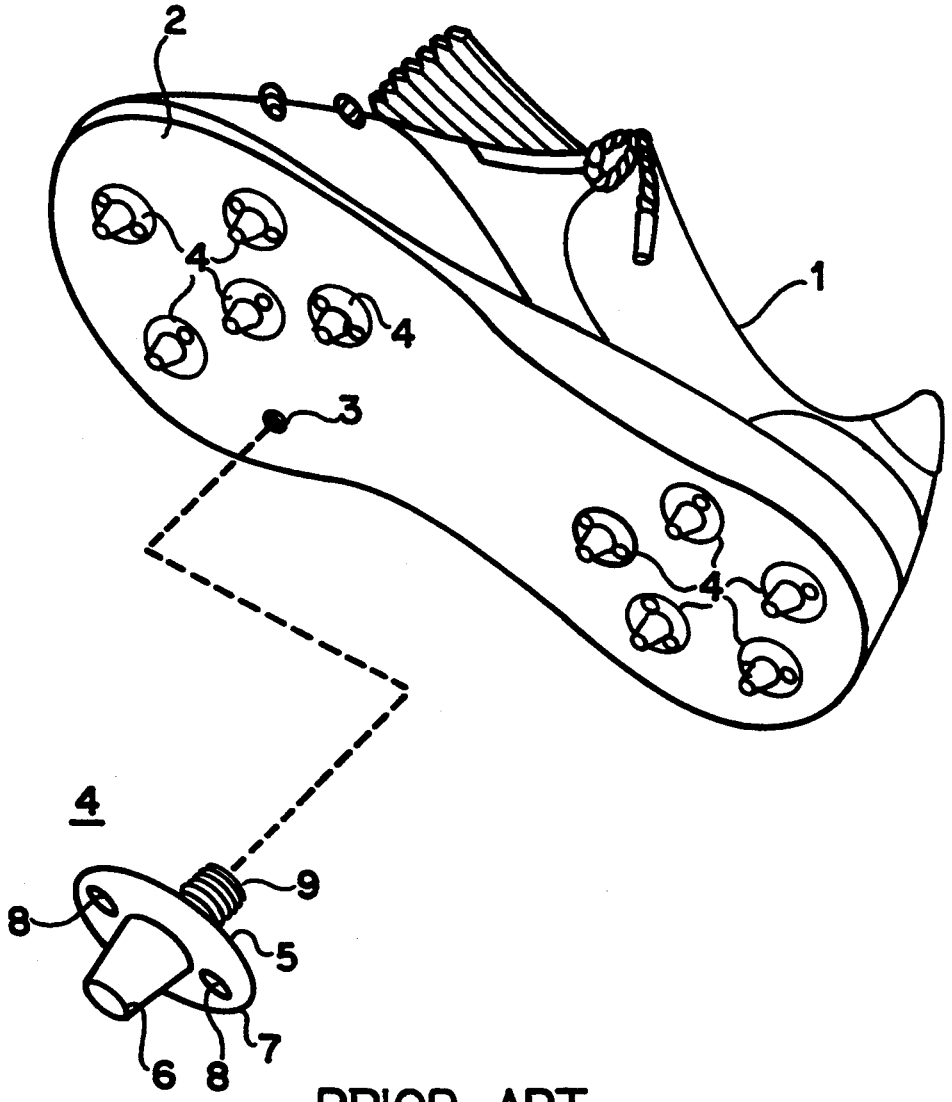
PRIOR ART FIG. 1
FIG. 1 is a partially exploded bottom perspective view of a typical prior art metal spiked golf shoe.
Figure 2:
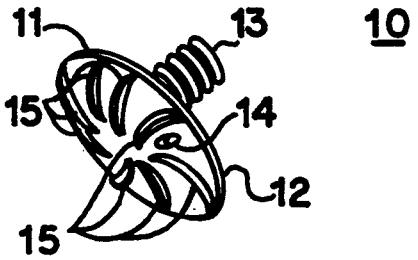
FIG. 2 is a perspective view of an embodiment of our winter golf shoe spike.

Referring again to the FIGS., our winter golf shoe spike 10 is illustrated in detail in FIGS. 2–10. Golf shoe spike 10 generally has a main cleat body 11 molded or otherwise formed of durable plastic material which is advantageously the same material used to manufacture the sole 2 of golf shoe 1. It should be noted that spike 10 may be manufactured from any suitable material or combination thereof, and it may easily be assembled from two or more separate pieces. For instance, the threaded stud 13, explained below, may be manufactured from a metal material such as aluminum, while the remainder of the cleat body 11 may be made of a synthetic plastic material.

Preferably, however, the main cleat body 11 is molded from a durable plastic type material in single unitary fashion. The cleat body 11 is preferably made from a plastic material which is also very resilient, even in temperatures below about 0° C. This way, the cleat maintains its resiliency for traction, and for protection of the turf, in cold weather. A preferred material for our cleat is polyether block urethane, available as Estane TM from B.F. Goodrich Co.

A threaded stud 13 is formed on the upper surface of generally concavo-convex flange 12 and protrudes axially therefrom. The threads on threaded stud 13 are sized to cooperate with the female threads of the threaded hole 3 in the sole 2 of golf shoe 1.

Threaded stud 13 may be a different cleat attachment means in other embodiments. For example, stud 13 may be a tipped prong that relies on a reversible snap-fit engagement with a slot or rim in hole 3. For now, however, we prefer the threaded stud for its firm and strong engagement with hole 3.

Optionally, the concave upper surface of flange 12 may be toughened, dimpled or furrowed to increase the friction between it and sole 2 when the cleat body 11 is tightened in position against the sole. Also, the concave feature of the upper surface tends to create more of a sharp edge there on the perimeter of the flange 12 for a firmer engagement with sole 2. Also, the concave feature of the upper surface tends to create a disc spring effect on cleat body 11 when threaded stud 13 is run into threaded hole 3 and tightened. This way, there is tension placed on stud 13, and its threads bind more securely with those of hole 3.

There is a slight recess provided in many golf shoe styles in sole 2 for a short annular distance around hole 3. For these styles, the flange 12 may be advantageously sized to fit snugly within the annular recess, thereby providing an ever firmer fit.

A plurality of traction ribs 15 are formed on the bottom traction surface of generally concavo-convex flange 12. While the ribs 15 may be present in a variety of configurations, preferably they are arranged in a radial fashion emanating from near the center of concavo-convex flange 12. The cross sectional shape of ribs 15 may be arcuate, triangular, rectangular or a combination thereof. Preferably, ribs 15 are triangular, but with rounded edges to provide the best compromise between traction and damage to the turf. By "rounded edges" we mean that whenever two surfaces meet (the edge), the region of the edge is free from sharp points or angularity (rounded). This is true wherever our cleat may meet the turf—on the ribs 15 and on the bottom surface of the flange. It is important that the ribs 15 not present an excessively aggressive surface to the ground. In this vein, the edges of the ribs are preferably rounded, both at their tops and sides, or merged smoothly into the bottom surface of flange 12. By "merged smoothly" we mean there is no break in the transition region between the surfaces which creates a sharp or abrupt edge. Referring specifically to FIGS. 7, 8, 9 and 10, the side edge features of the ribs are shown in more detail. Different rounded side and top edges for the ribs 15 are shown. The side edges may be rounded and merged smoothly with flange 12 on the outside as depicted by 16; or merged smoothly with flange 12 on the inside as depicted by 17. In any event, no sharp point or abrupt or angular edge exists on the rib or on the bottom surface of the flange or on the side of the flange to cause damage to the ground. Furthermore, the shoulder 18 at the bottom circumference of flange 12 is preferably also rounded or merged smoothly into the bottom surface of flange 12.

By "generally concavo-convex from the perspective of sole 2" we mean that flange 12 bends slightly away from sole 2 at both its upper and its lower surfaces. These bends, however, may be different and they may be very slight. The upper bend aids in securely engaging the cleat body 11 to the shoe sole 2 as disclosed above. The lower bend aids in enlarging the surface area of the cleat to provide more room for traction ribs 15, and to provide more surface area over which to distribute the weight of the golfer, two goals of our invention. The maximum lower bend would be for a hemispherical cleat, but we prefer one less pronounced than that, about one-half hemispherical. By "one-half hemispherical" we mean a spherical cap zone where the first plane which intersects the sphere is one-half the radius of the sphere away from the second parallel plane which is tangential to the sphere. This way, the cleat is not so pronounced, and it does not do so much damage to the turf. The minimum lower bend would be for a flat cleat, but we prefer one more pronounced than that. This way, there is more angle on the sides of the cleat surface, and the ribs there are presented to the turf more aggressively for more traction.

By "flange" we mean a projecting rim or collar around threaded steel 13 to form a disk-like structure. This way, the flange 12 is relatively thin and the length of cleat body 11 from the flange's upper surface to the bottom of ribs 15 is not great, preferably about 0.25" or less. The flange may be circular, square, rectangular, or any other shape. Most common shoe styles are designed for circular cleat flanges.

By "ribs" we mean more than one vertical ridges in the bottom surface of flange 12. The ridges have a crest that is at least one line, compared to the crest of the prior art spikes which are a point or a circle (for a truncated cone, for example). Preferably, the ridges are about as wide at their base as they are high. The ridges may be straight or curved in planes parallel to the shoe sole, and they may be chords, diameters, or radii of the bottom surface of the disk-like flange 12. Preferably, the ridges are between about 0.03125" and 0.125" high. Preferably, the flange's bottom surface has 8 crescent shaped ridges.

Figure 3:
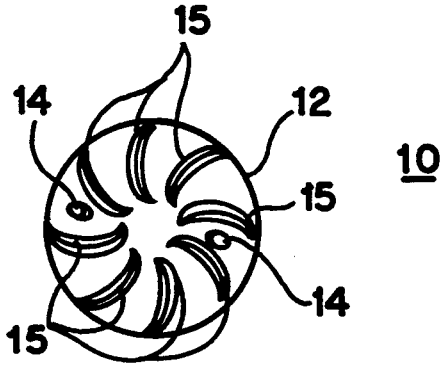
FIG. 3 is a bottom view of an embodiment of our winter golf shoe spike showing the traction surface.
Figure 4:
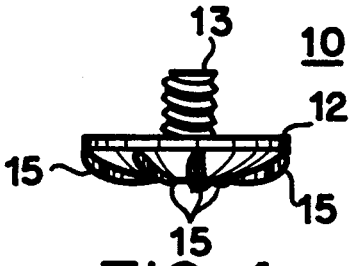
FIG. 4 is a side view of an embodiment of our winter golf shoe spike, the remaining side views being identical and unadorned.
Figure 5:
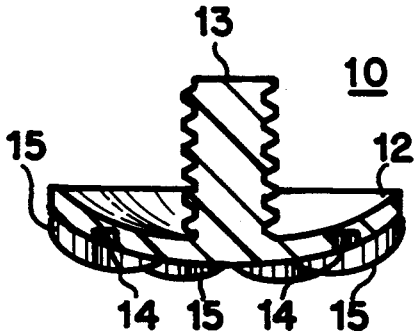
FIG. 5 is a side, cross-sectional view of the winter golf shoe spike depicted in FIG. 4.
Figure 6:
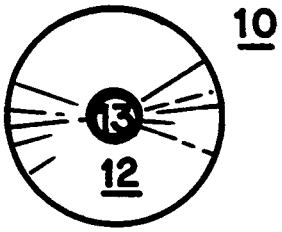
FIG. 6 is a top view of an embodiment of our winter golf shoe spike.
Figure 7:
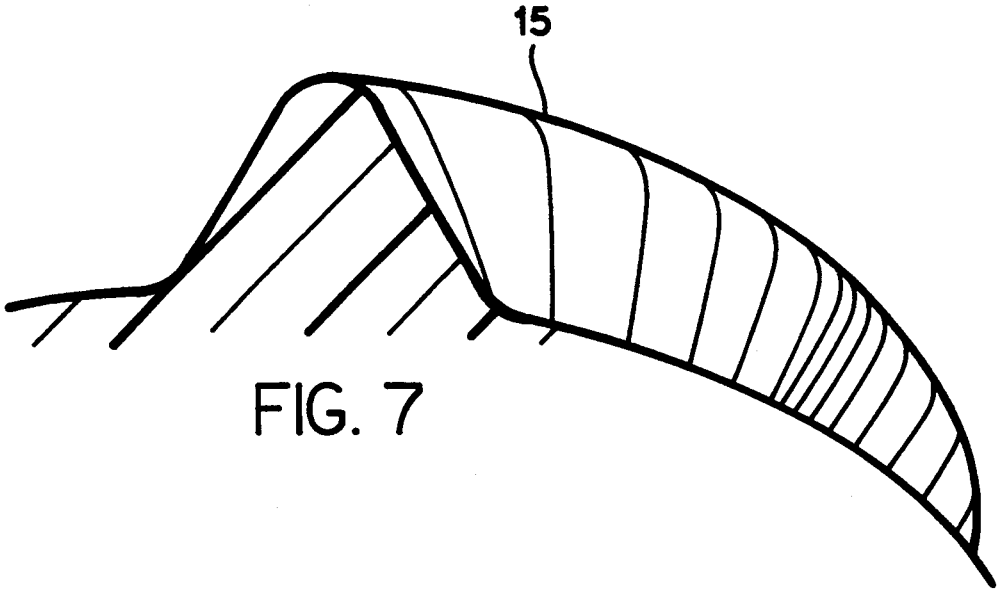
FIGS. 7–9 are partial, cross-sectional views of different embodiments of the traction ribs of our invention.
Figure 8:
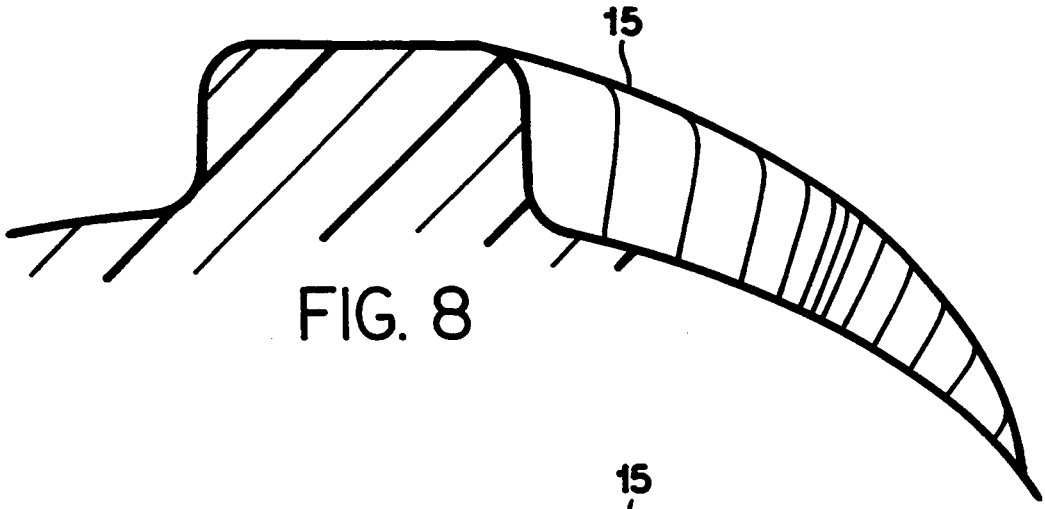
Figure 9:
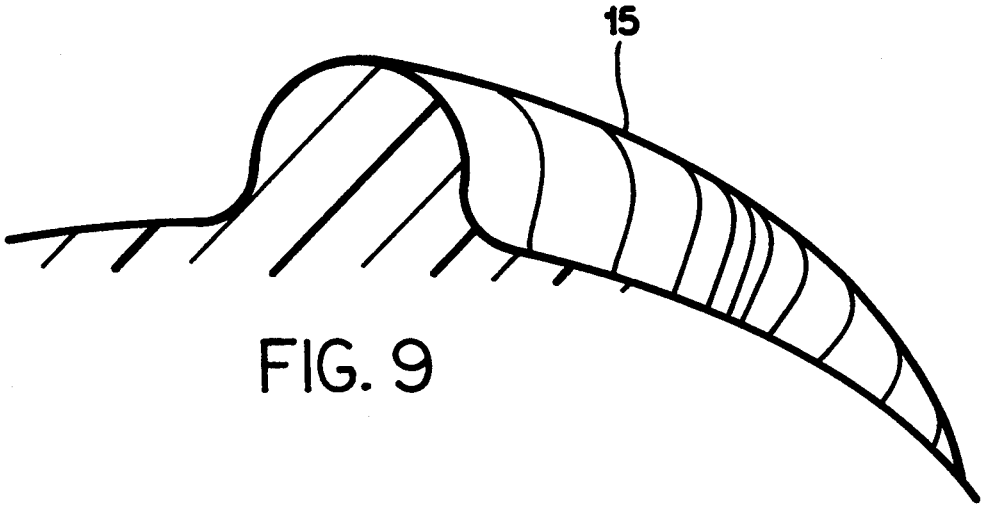
Figure 10:
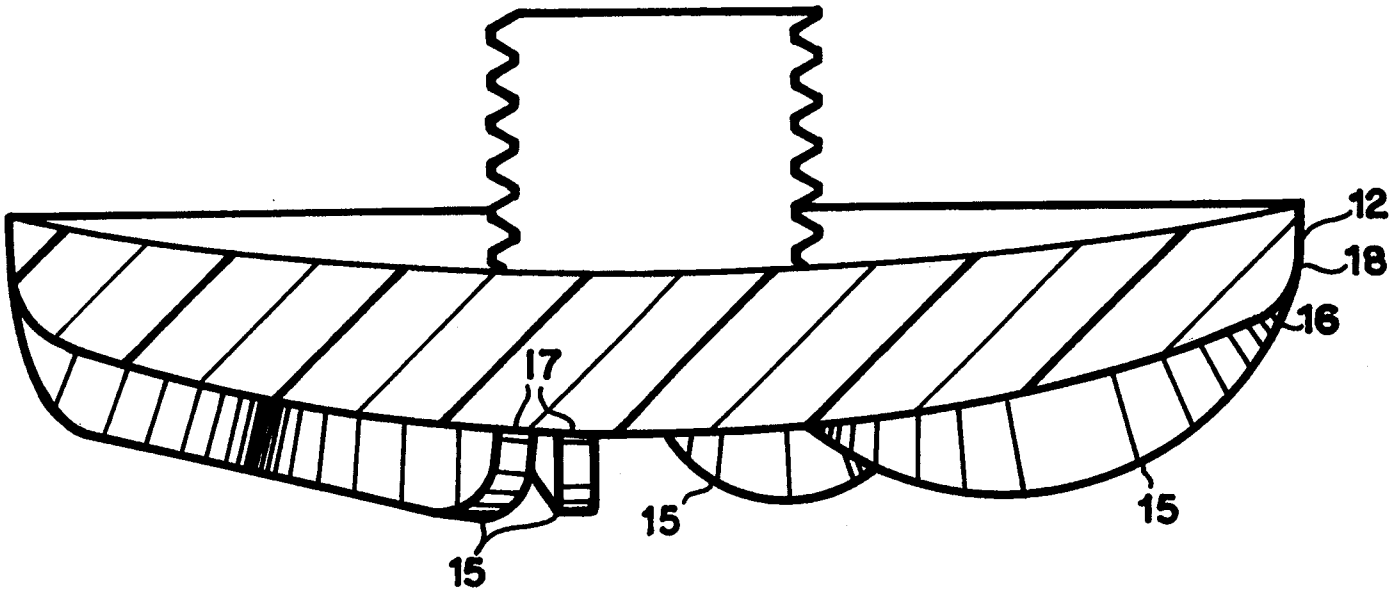
FIG. 10 is an enlarged, side, cross-sectional view of an embodiment of our invention.

As can be seen in FIGS. 4 and 5 the ridge outer surfaces project into and define planes which are parallel to the shoe sole. Such planes are defined as planes of projection and the ridges are shown in FIG. 3 as being curved in the plane of projection parallel to the shoe sole.

Optionally, a pair of installation tool engagement holes 14 are provided at diametrically opposing points in the bottom surface of flange 12. The conventional installation tool has two prongs which fit into engagement holes 14, plus a shaft and a handle like a screwdriver to help impart rotary motion to cleat body 11. This way, the cleat body 11 may be conveniently driven in and out of the threaded hole 3 on threaded stud 13, and securely tightened in the in position against sole 2.

In use, the golfer simply removes the metal cleats on his or her golf shoes with the installation tool and replaces the metal cleats with the winter golf shoe spikes 10 of the instant invention.

While there is shown and described the present preferred embodiment of the invention, it is to be distinctly understood that this invention is not limited thereto, but may be variously embodied to practice within the scope of the following claims.

We claim:

1. A cleat for a shoe sole comprising:

a disk-like flange, having an upper surface for placement underneath and in contact with the shoe sole along at least the periphery of said flange, and having an opposing bottom surface;

a plurality of traction ribs formed on said bottom surface, said ribs being vertical ridges curved in a plane of projection parallel to the shoe sole, emanating out in radial fashion from the center of the disk-like flange, and being integrally formed with and extending down from said bottom surface for supplying traction against the ground.

2. A cleat for a shoe sole comprising:

a disk-like flange, having a concave upper surface for fitting in a snug and gripping manner against the shoe sole along at least the periphery of said flange, said flange having an opposing convex bottom surface;

a plurality of traction ribs formed on said bottom surface, said ribs being vertical ridges curved in a plane of projection parallel to the shoe sole, and emanating out in radial fashion from the center of the disk-like flange, said ribs being integrally formed with and extending down from said bottom surface, and being made of a resilient plastic material for supplying traction with the ground, and a threaded stud, integrally formed with and extending up from the center of said upper surface, for removably attaching the cleat to the shoe sole, whereby the cleat provides traction, but does not damage the surface being walked upon.

3. A shoe cleat, comprising:

a disk-like flange for contacting with a sole of a shoe, the disk-like flange having an upper surface for placement underneath the sole of a shoe, said flange further including a bottom surface opposite the upper surface;

a plurality of crescent shaped ridges for supplying traction against the ground, the ridges being integrally formed with and projecting from the bottom surface, the ridges emanating in a radial fashion from near the center of the opposing bottom surface of the disk-like flange and being formed of a resilient material and an attachment means extending from the upper surface, for removably attaching the cleat to a shoe, whereby the cleat provides traction while minimizing damage to surfaces walked upon.

4. A shoe cleat as claimed in claim 3, wherein the crescent shaped ridges are triangular in cross section.

5. A shoe cleat as claimed in claim 3, wherein the crescent shaped ridges are square in cross section.

6. A shoe cleat as claimed in claim 3, wherein the crescent shaped ridges are arcuate in cross section.

7. A shoe cleat as claimed in claim 3, wherein eight ridges are included on the bottom surface of the disk-like flange.

8. A shoe cleat as claimed in claim 3, wherein the bottom surface of the disk-like flange curves in a smooth, half-hemispherical shape.

9. A shoe cleat, comprising:

a circular disk-like flange, having an upper surface for placement underneath the sole of a shoe along at least the periphery of said flange, said flange further including an opposing bottom surface which curves outwardly from a plane defined by an outer periphery of the upper surface of the disk-like flange;

a plurality of crescent shaped ridges for supplying traction against the ground, said ridges having a cross sectional shape and being integrally formed with and projecting from the bottom surface, the ridges emanating out in a radial fashion from near the center of the opposing bottom surface of the disk-like flange and being formed of a resilient material; and an attachment means extending from the upper surface for removably attaching the cleat to a shoe, whereby the cleat provides traction while minimizing damage to surfaces walked upon.

10. A shoe cleat as claimed in claim 9, wherein the ridges have a triangular cross sectional shape.

11. A shoe cleat as claimed in claim 10, wherein the crescent shaped ridges have a triangular shaped cross sectional area which is of variable width and is widest at a central portion thereof and progressively narrower toward each end thereof.

12. A shoe cleat as claimed in claim 9, wherein the curve in the bottom surface is such that a central portion of the bottom surface is located at a position the greatest perpendicular distance form the plane defined by the outer periphery of the upper surface.

13. A shoe cleat, comprising:

a circular disk-like flange, having an upper surface for placement underneath the sole of a shoe along at least the periphery of said flange, said flange further including an opposing bottom surface which curves outwardly from a plane defined by an outer periphery of the upper surface of the disk-like flange, wherein the curve in the bottom surface is such that a central portion of the bottom surface is located at a position the greatest perpendicular distance from the plane defined by the outer periphery of the upper surface;

a plurality of crescent shaped ridges for supplying traction against the ground, the ridges having a cross sectional shape and being integrally formed with and projecting from the bottom surface, the ridges emanating out in a radial fashion from near the center of the bottom surface, the ridges being formed of a resilient material and being triangular and variable in cross sectional shape and cross sectional area with the widest triangular shaped cross sectional area being at a central portion thereof and progressively narrower toward each end thereof; and, an attachment means extending from the upper surface for removably attaching the cleat to a shoe, whereby the cleat provides traction while minimizing damage to surfaces walked upon.

* * * * *